US009739045B1

(12) United States Patent
Jones

(10) Patent No.: US 9,739,045 B1
(45) Date of Patent: Aug. 22, 2017

(54) SHOWER FLOOR DRAIN

(71) Applicant: Keith Douglas Jones, Virginia Beach, VA (US)

(72) Inventor: Keith Douglas Jones, Virginia Beach, VA (US)

( * ) Notice: Subject to any disclaimer, the term of this patent is extended or adjusted under 35 U.S.C. 154(b) by 0 days.

(21) Appl. No.: 14/998,654

(22) Filed: Jan. 28, 2016

(51) Int. Cl.
*A47K 3/00* (2006.01)
*E03F 5/04* (2006.01)

(52) U.S. Cl.
CPC ..... *E03F 5/0408* (2013.01); *A47K 3/00* (2013.01)

(58) Field of Classification Search
CPC ..... A47K 3/40
USPC ..... 4/596–614
See application file for complete search history.

(56) References Cited

U.S. PATENT DOCUMENTS 4,477,934 A * 10/1984 Salminen ..... A47K 4/00 4/596
4,622,911 A * 11/1986 Salminen ..... A47K 4/00 114/71
5,458,769 A * 10/1995 Johannessen ..... E03F 5/0407 210/163
6,014,780 A * 1/2000 Jurek ..... A47K 3/283 4/613
2011/0126350 A1* 6/2011 Wedi ..... A47K 3/40 4/613
2012/0036630 A1* 2/2012 Cook ..... E03F 5/0408 4/679

* cited by examiner

*Primary Examiner* — Lori Baker
(74) *Attorney, Agent, or Firm* — Stephen E. Clark

(57) ABSTRACT

A concealed-shower drain assembly has a rigid vertical flange continuously joined in fixed orientation along one side of a rigid horizontal deck member. An opening in the horizontal deck leads to a sealed drain box on the underside of the deck. A drain pipe at the bottom of the drain box provides egress of waste shower water from the drain box. A removable access panel is supported in the deck opening by a plurality of support posts affixed to the interior wall of the drain box. A continuous gap between the periphery of the access panel and the sides of the opening in the horizontal deck provides a flow path for shower waste water into the drain box. The drain assembly can be securely attached in place in a shower stall by nailing or screwing the rigid vertical flange directly to the framing of the shower stall.

1 Claim, 12 Drawing Sheets

SHOWER FLOOR DRAIN

CROSS-REFERENCE TO RELATED APPLICATION

This application claims the benefit of prior provisional patent application Ser. No. 62/108,722, filed Jan. 28, 2015.

BACKGROUND OF THE INVENTION

1. Field of the Invention

The present invention relates to plumbing fixtures, and more particularly to a concealed drain disposed at the base of a shower and method of installing same.

2. Description of the Prior Art

Conventional shower floor drains are difficult to install susceptible to leakage if installed incorrectly, are susceptible to displacement during installation, require careful pre-installation handling, are difficult to clean and are generally aesthetically unattractive. Although some prior shower drainage systems comprise so-called concealed drains, which are, intended to hide the visibly less attractive aspects of such drains, a common problem of prior concealed drains is that they can be operationally difficult to access and clean, which negatively impacts the function of the drain. Accordingly, what is needed is a rigid and durable concealed shower drain that is easily installed and aesthetically attractive and can be readily accessed for cleaning by the user.

U.S. patent application No. 2008/0158474 to Witt discloses a shower base with a flow-enhancing covered drain. Drain flow is achieved through a narrow peripheral passage between the drain cover and the drain well in which it is seated. A problem with this device is that the drain is adapted so as only to be located away from the shower wall and is not adapted to be secured to the shower wall.

U.S. Pat. No. 5,458,769 to Johannsessen discloses a floor drain the comprises a system of slots that are intended to create a sucking phenomenon that is purported to its size. A problem with this device is that it is not adapted to be secured directly the shower wall.

US patent application No1. 2011/0126350 to Wedi discloses a shower drain system and receiving element for a shower drain that is designed as a separate, box-like hollow body that is constructed as a component of the shower wall and includes a vertical veneer element that can be reversibly and revmovably attached to the shower wall. A problem with this device is that it cannot be constructed as a unitized rigid structure that can be installed in place with only a handful of fasteners.

US Patent Application Publication 2012/0036630 to Cook discloses a cover for a concealed drain that comprises a drain body that is adapted to be connected to a convention prefabricated waterproof shower or bath pan. A drain cover is supported by an array of upwardly directed posts that are attached to the floor of the drain fixture. A problem with this device is that it is not adapted to be secured directly to the shower wall.

U.S. Pat. No. 6,014,780 to Jurek et al. discloses a shower bath and drain in which ingress to the drain is through a vertical gap between the base of the sPatent Application Publication No. 2013/0318705 to Plank et al discloses a lileable drain system in which the shower floor comprises an array of surface tiles, and one of such tiles is supported above a drain pipe. Ingress to the drain is provided through gaps around the perimeter of the tile that is disposed above the drain. A problem with this device is that it requires a pan to lock the drain into place. Another problem with this device I that is has no access for cleaning of the drain pipe.

Another well know shower drain design is manufactured by Schluter Systems. The Schluter drain device is not adapted to be secured, such as by screw fasteners, to the shower wall frame and, in order to provide a watertight seal between the drain and the shower wall, relies on a flexible skirt that, during installation, must be embedded in tiling mud.

There is, then, a need for a concealed shower floor drain that overcome the above described problems in the prior art.

OBJECTS AND SUMMARY OF THE INVENTION

In light of the foregoing background, the present invention provides an aesthetically attractive concealed shower drain assembly that, in operation, can be advantageously installed at the intersection of a wall and the floor of a tiled shower stall. The present invention comprises a rigid horizontal deck portion surrounding a drain opening. A drainage box disposed beneath and extending downwardly from the drain opening funnels waste shower water from above the drain assembly to a drain pipe at the bottom of the drainage box. A rigid vertical flange forms a fixed and continuous intersection with the horizontal deck. The drainage box, the vertical flange, the horizontal deck and the drain pipe together form a unitized rigid structure.

It is an object of the present invention to provide a drain system where the drainage box and drain pipe are covered by a user-removable access panel that can be removed, without necessitating the use of tools, to provide access to the drain pipe, strainer and drainage box for cleaning.

It is another object of the present invention to provide a drain system that is adapted to accommodate high rates of waste water flow from the shower floor, down into the drainage box, through an elongated opening between the periphery of the access panel and an opening in the horizontal deck of the drain assembly.

It is another object of the present invention to provide a shower drain of the character described that can be easily installed during construction of a tiled shower stall, prior to installation of the shower tiling.

It is another object of the present invention to provide a shower drain of the character described wherein the vertical flange of the drain assembly can be securely fastened, such as by screws or nail, directly to framing members (such as studs) of the shower stall.

It is another object of the present invention to provide support shoulders, recessed within the drainage box, that hold the removable access panel in place during operation (i.e., when the shower is being used), preventing movement of the access panel in a horizontal plane.

It is another object of the present invention to provide a shower drain of the character described, wherein the support shoulders additionally prevent the removable access panel from undesirably tilting in a vertical plane when stepped on from above.

It is an object to provide a modified embodiment of the present invention that further comprises a removable drain strainer that is hidden from view during use, but which is readily accessible for cleaning when the drain is not in use.

It is another object to provide a modified embodiment of the invention that includes a wall drain that is adapted to be installed on the bottom of a wall of a tiled shower so as to allow the water to drain through a vertical gap between the wall and floor.

Other objects, features and advantages of the present invention will become readily apparent from the following detailed description of the preferred embodiment when considered with the attached drawings and the appended claims.

REFERENCE NUMERALS IN DRAWINGS

Figure 1:
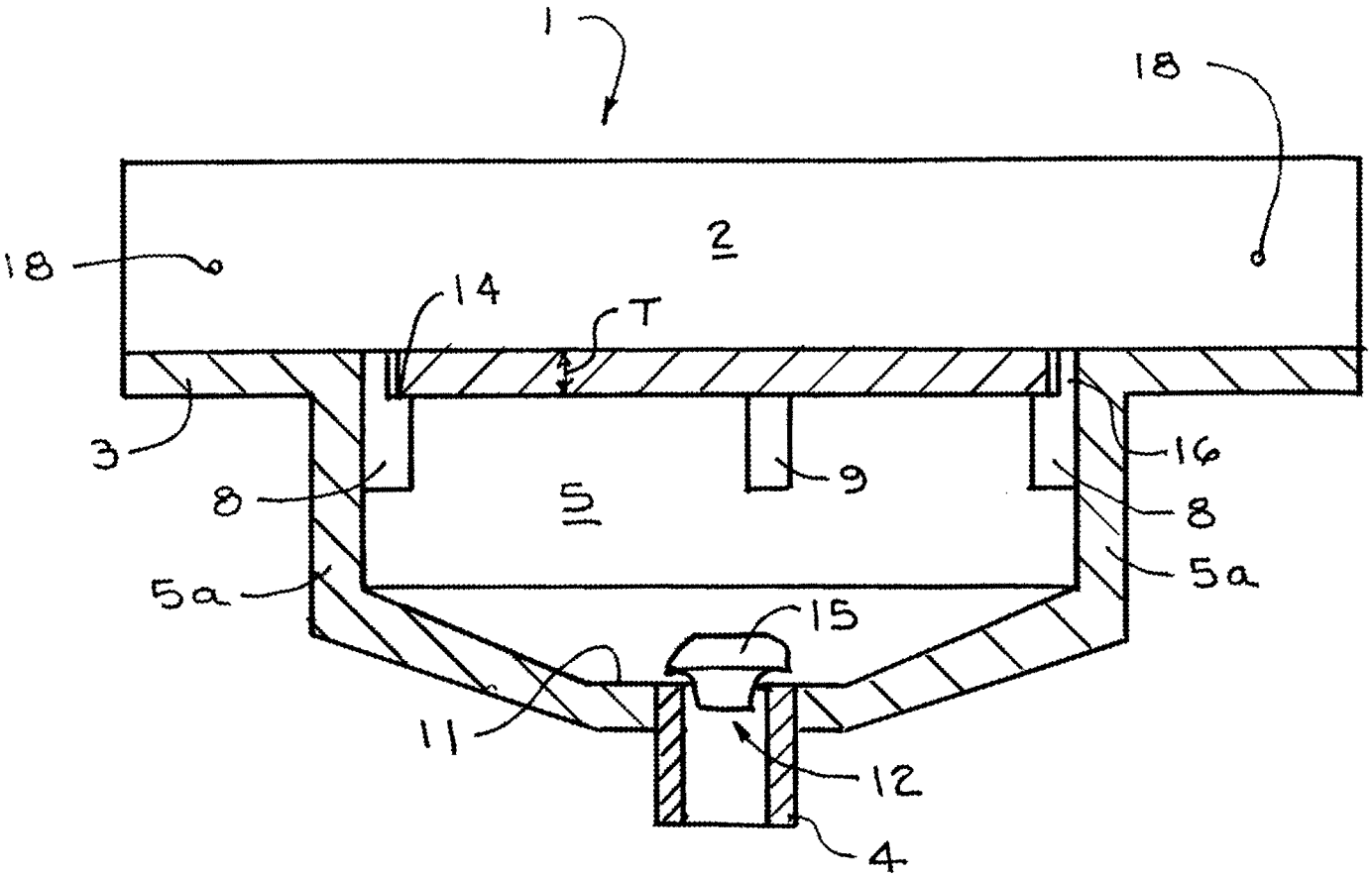
FIG. 1 is a side elevation view of a linear drain embodiment of the present invention.

B Cement Backer Board
C Tile
D Dimension (of Gap 7)
F Shower Floor
S Silicone Sealant
T Thickness (of access panel 6)
W Shower Wall
1 Linear Drain Assembly
2 Vertical Flange
3 Horizontal Deck
4 Drain pipe
5 Drainage box
5*a* Drainage box Wall
6 Access panel
7 Gap
8 Corner support post
9 Intermediate support post
10 Drain opening
11 Drain box floor
12 Drain outlet
13 Top, support post
14 Shoulder, support post
15 Strainer
16 Guide member, panel
17 Deck corner
18 fastener hole, flange
19 Fastener hole, deck
20 Fastener
30 Corner Drain Assembly
32 Vertical flange, corner drain assembly
33 Horizontal Deck, corner drain assembly
36 Access Panel, corner drain assembly
39 Drain Opening, corner drain assembly
40 Wall Drain Assembly
42 Vertical flange, wall drain assembly
43 Horizontal Deck, wall drain assembly
46 Access Panel, wall drain assembly
48 Support tab, wall drain assembly
49 Drain Opening, wall drain assembly

DETAILED DESCRIPTION OF THE PREFERRED EMBODIMENT

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 2:
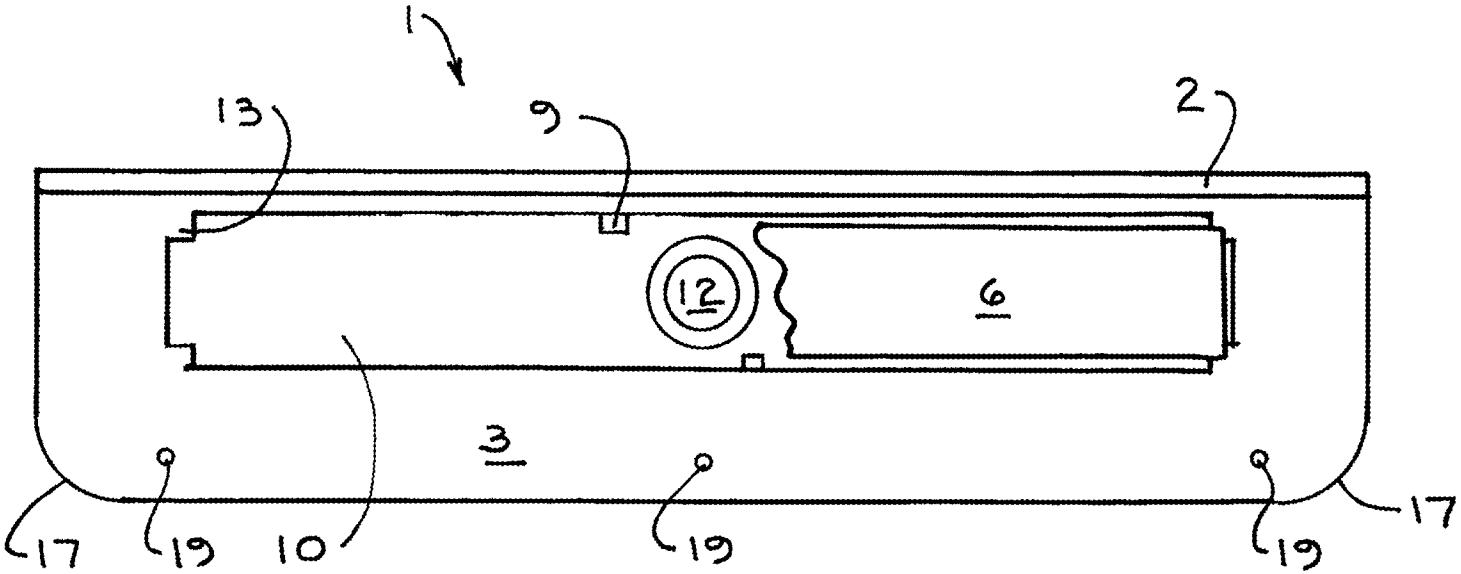
FIG. 2 is a plan view of the linear drain device shown in FIG. 1.
Figure 3:
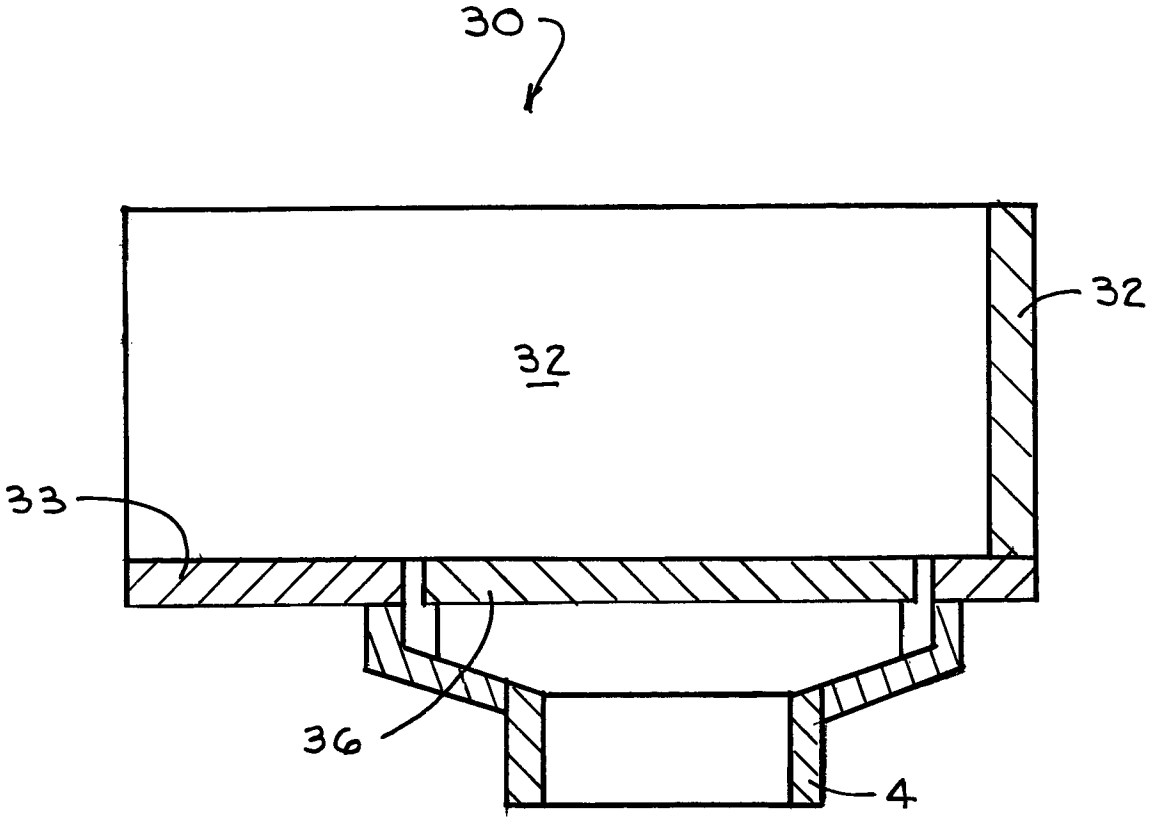
FIG. 3 is a side elevation view of a corner drain embodiment of the present invention.

Referring now to FIGS. 1 and 2, there is shown a front and top view, respectively, of a linear drain assembly, generally designated 1 in the drawings.

In the preferred embodiment of the present invention, the linear drain assembly 1 comprises a rigid horizontal deck 3 that has a drain opening 10. In the preferred embodiment of the invention both the horizontal deck 3 and the drain opening 10 are generally of a rectangular shape. The outboard corners 17 of the horizontal deck preferably are fixed radius curves, rather than sharp corners, to enhance the strength of the mud joint around the deck 3 when the device is installed in a shower floor. A drainage box 5 is disposed beneath the horizontal deck3 and has continuous walls 5*a*, which extend downwardly from the periphery of the drain opening 10. The drain box walls 5*a* are continuously connected at their bottom portion to the drain box floor 11 and at their top portion to the underside of the horizontal deck 3. A drain pipe 4 extends downwardly from an opening in the drain box floor 11. In the preferred embodiment of the invention, a portion of the drain box floor 11 is sloped so as to direct gravity flow of waste shower water out of the drain box 5 through the drain pipe 4 when the assembly is in operation.

It will be understood that the drainage box walls 5*a* form a continuous, closed and watertight seal with the horizontal deck 3 around the periphery of the drain opening 10.

A rigid vertical flange 2 forms a fixed, continuous and watertight intersection with the horizontal deck 3 along one of its elongated sides. The vertical flange 2 and the horizontal deck 3 form an "L" in cross section along the entire length of one long side of the horizontal deck 3.

The drainage box 5, the vertical flange 2, the horizontal deck 3 and the drain pipe 4 together form a unitized rigid structure. In the preferred embodiment of the invention, the drainage box 5, the vertical flange 2, the horizontal deck 3 and the drain pipe 4 are all constructed as a single molded plastic part.

A panel corner support post 8 is attached to the drainage box wall 5*a* in each corner of the drainage box 5. Each panel corner support post 8 has a substantially horizontal support post shoulder 14 that is recessed below the upper surface of the horizontal deck 3.

A rigid access panel 6 removably rests on the shoulder 14 of the panel corner supports posts 8.

In the preferred embodiment of the invention, a panel guide member 16 is disposed in each corner of the drainage box 5. Each panel guide member 16 preferably protrudes a finite distance (D) from the two intersecting walls 5*a* that form each vertical corner of the drainage box 5. In the preferred embodiment of the invention, the access panel is similar in shape to the (preferably rectangular) drain opening 10, but is smaller in length and width than the corresponding length and width of the drain opening, so as to provide a substantially continuous gap 7 of dimension D between the periphery of the access panel 6 and the opening 10 in the horizontal deck 3. It will be understood that, in operation, shower waste water may advantageously gravity flow from above the horizontal deck 3, through the gap 7, downwardly into the drainage box 5, and then out of the drainage box 5 via the drain pipe 4.

In the preferred embodiment of the invention one or more pairs of intermediate support posts 9 is attached intermediately on opposite sides of the drainage box wall 5*a* to provide additional support to the access panel 6.

In the preferred embodiment of the invention, the width and length of the access panel 6 is substantially equal to 2×D less than the width and length, respectively, of the opening 10 in the horizontal deck 3, such that access panel 6 fits between opposing guide members 16, whereby the array of panel guide members 16 prevent horizontal movement of the access panel 6 within the opening 10 in the horizontal deck 3.

By way of example only, the dimensions of a linear drain assembly 1 constructed in accordance with the preferred embodiment of the invention are as follows:

The length of the horizontal deck 3 and the vertical flange 2 is 28½". The vertical flange 2 extends to a maximum height of 2 inches above the upper surface of the ½-inch thick horizontal deck 3. The horizontal deck 3 is 5½" wide, as measured from the back side of the vertical flange 2. The drain opening 10 in the horizontal deck 3 is 2½ inches wide by 24½ inches long. The access panel 6 is 2 inches wide by 24 inches long, thereby providing a substantially uniform and continuous ¼-inch gap between the edge of the panel 6 and the edge of drain opening 10 in horizontal deck 3.

The intermediate support post 9 and the corner support post 8 are each ½-inch square in horizontal cross section.

Each guide member 16 protrudes approximately ¼" from the wall 5*a* of the drain box 5 to provide a substantially continuous ¼-inch gap 7 between the perimeter of the access panel 6 and the edge of the drain opening 10 in the horizontal deck 3.

Installation

As will be described more fully herein below, the linear drain assembly 1 is constructed so as to be installed against a vertical wall (W) of a tiled shower stall at the shower floor (F). In operation, the linear drain assembly 1 is recessed relative to a tiled shower floor F, such that waste shower water flows from the shower floor F, through gap 7 between the horizontal deck 3 and the removable access panel 6, downwardly into the drainage box 5, then out of the drainage box through drain pipe 4.

The preferred method of installing the linear drain assembly 1 in a shower stall will now be described.

Figure 14:
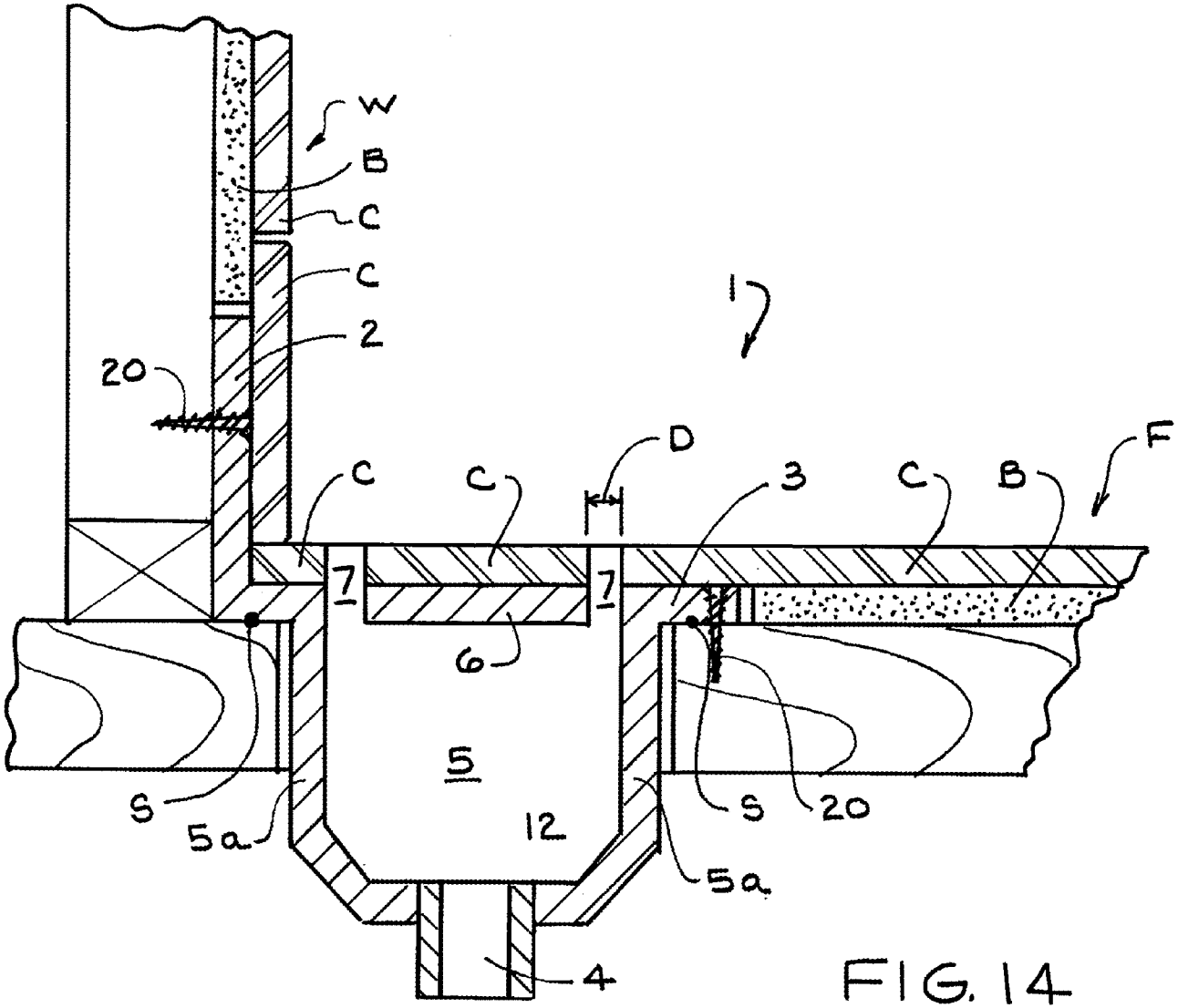
FIG. 14 is a cross-sectional view showing a preferred method of installation of a drain assembly constructed in accordance with the present invention.

Referring to FIG. 14: The linear drain assembly 1 is initially placed in an opening in the subfloor of a roughed out shower stall. A continuous bead of silicone sealant (S) or the like is preferably applied to the shower stall subfloor, between the underside of the horizontal deck 3 and the subfloor.

The outboard face of the vertical flange 2 is securely fastened directly to the wall frame (preferably to the studs) with screw or nail fasteners 20. The vertical flange 3 may be provided with pre-drilled fastener holes 18 to facilitate screwing of the vertical flange 3 to the wall studs. The horizontal deck 3 is securely fastened directly to the subflooring with screw or nail fasteners 20. The horizontal deck 3 may be provided with pre-drilled fastener holes 19 to facilitate screwing of the horizontal deck to the subflooring. It will be understood that after the vertical flange 3 has been fastened to the wall framing, and the horizontal deck 3 has been fastened to the subflooring, the unitized rigid subassembly comprising the vertical flange 3, drainage box 5 and horizontal deck 3 will all be rigidly held in place and will not be susceptable to being displaced during completion of construction operations in the shower stall.

In the preferred embodiment of the invention, the horizontal deck 3 is ½" thick, corresponding to the thickness of the cement board B that typically forms the base of tiled shower floor. Similarly, the vertical flange 2 is ½" thick, corresponding to the thickness of the cement board B that typically forms the base for the tiled shower wall.

After the drain subassembly comprising the vertical flange 2, the drainage box 5 and the horizontal deck 3, has been fastened to the shower stall framing, cement board B, which has the same thickness as the vertical flange 2 and the horizontal deck 3, is then attached to all exposed interior surfaces of the roughed-out shower stall.

After the drain subassembly (comprising the vertical flange 2 the drainage box 5 and the horizontal deck 3) and the cement board B have been installed, mud and tile (C) can be applied to the exposed face of the horizontal deck 3 (as well as the remainder of the shower floor F), and to the exposed face of the vertical flange 2 (as well as the remainder of the shower wall W) in the standard manner of constructing tiled shower surfaces. It will be understood that, as the tile C and mud (not shown) extend uniformly in a plane across both the cement board and the horizontal deck 3 at the floor, and across both the vertical flange and the cement board at the wall, the described drain assembly installation is watertight at both the shower wall W and the shower floor F, and requires no additional sealing members. It will also be understood that, since the mud and tile C are applied directly over the vertical flange 2 and the horizontal deck 3, the fasteners 20 are hidden from view and fastener holes 18, 19 are sealed against water leakage.

In a similar manner by which mud and tile C are applied to the shower floor F, mud and tile C are also preferably applied to the exposed upper surface of the access panel 6.

In a preferred embodiment of the invention a hair strainer 15 is removably disposed within the drainage box 5 at the drain pipe 4. The hair strainer 15 can be easily accessed, without requiring the use of tools, by lifting the access panel 6 by hand from the support posts on which it rests.

It will be understood from the above description that the drain subassembly (comprising the vertical flange 2 the drainage box 5 and the horizontal deck 3) together form a unitized rigid structure that can advantageously be constructed, handled and installed in place in a shower stall as a single part.

It will be understood that the present invention can be installed at any point along the floor-wall intersection of the shower, including in the corner or in the middle of a wall. An alternative embodiment of the present invention comprises an elongated recessed drain that extends along the entirety of one of the edges of the shower. In this embodiment of the invention, the drain is adapted to be substantially hidden from view, providing users with all of the function of convention drains without the aesthetically unappealing appearance.

Figure 4:
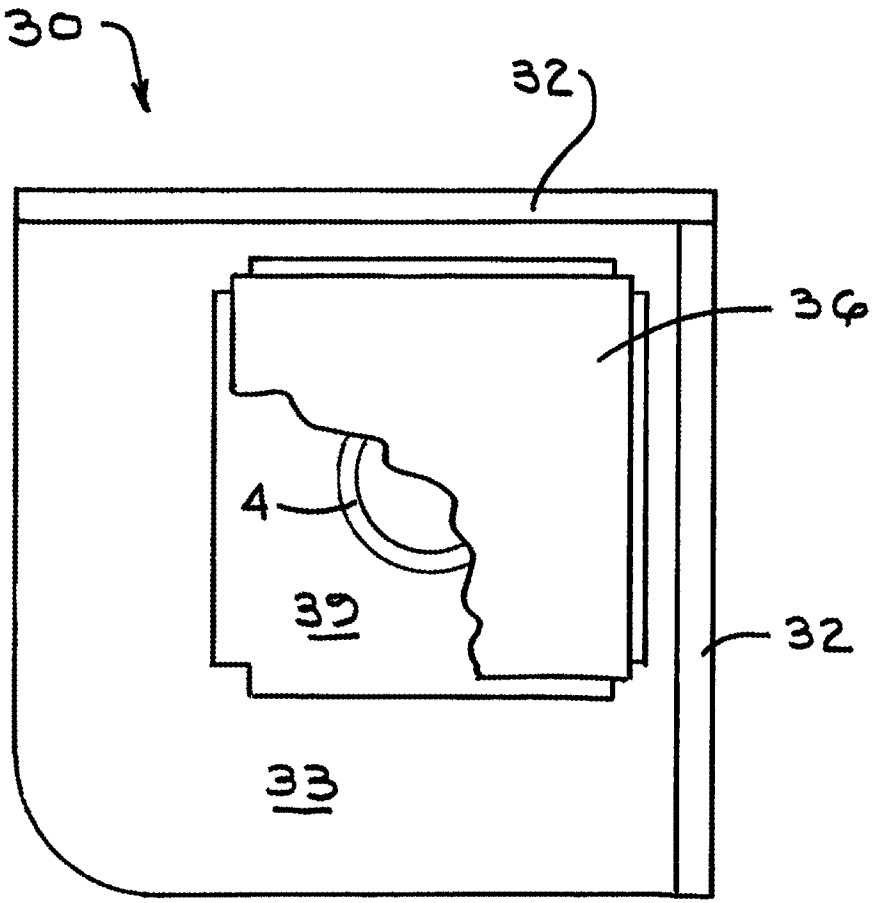
FIG. 4 is a plan view of the corner drain device shown in FIG. 3.
Figure 6:
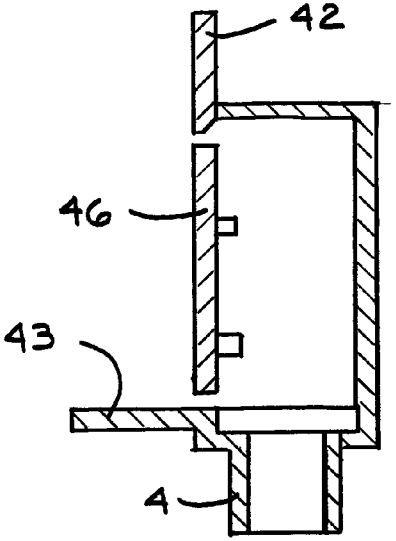
FIG. 6 is a side elevation view of a wall drain embodiment of the present invention.
Figure 7:
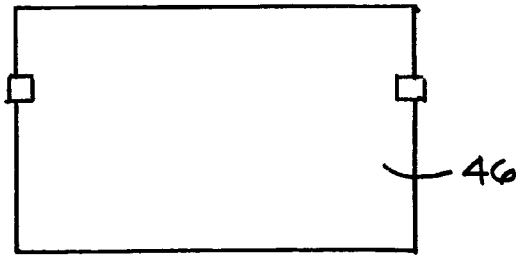
FIG. 7 is a side elevation of an access panel used in conjunction with the wall drain embodiment of the present invention.
Figure 5:
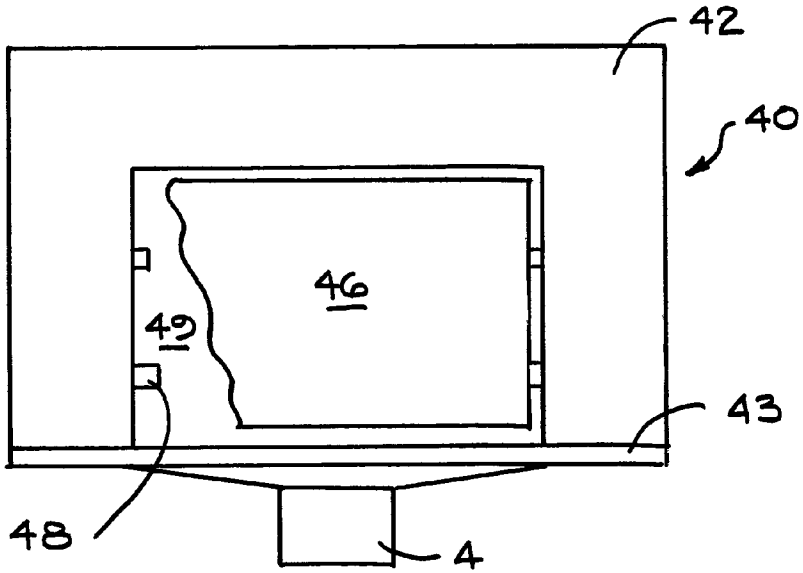
FIG. 5 is a front elevation view of a wall drain embodiment of the present invention.
Figure 8:
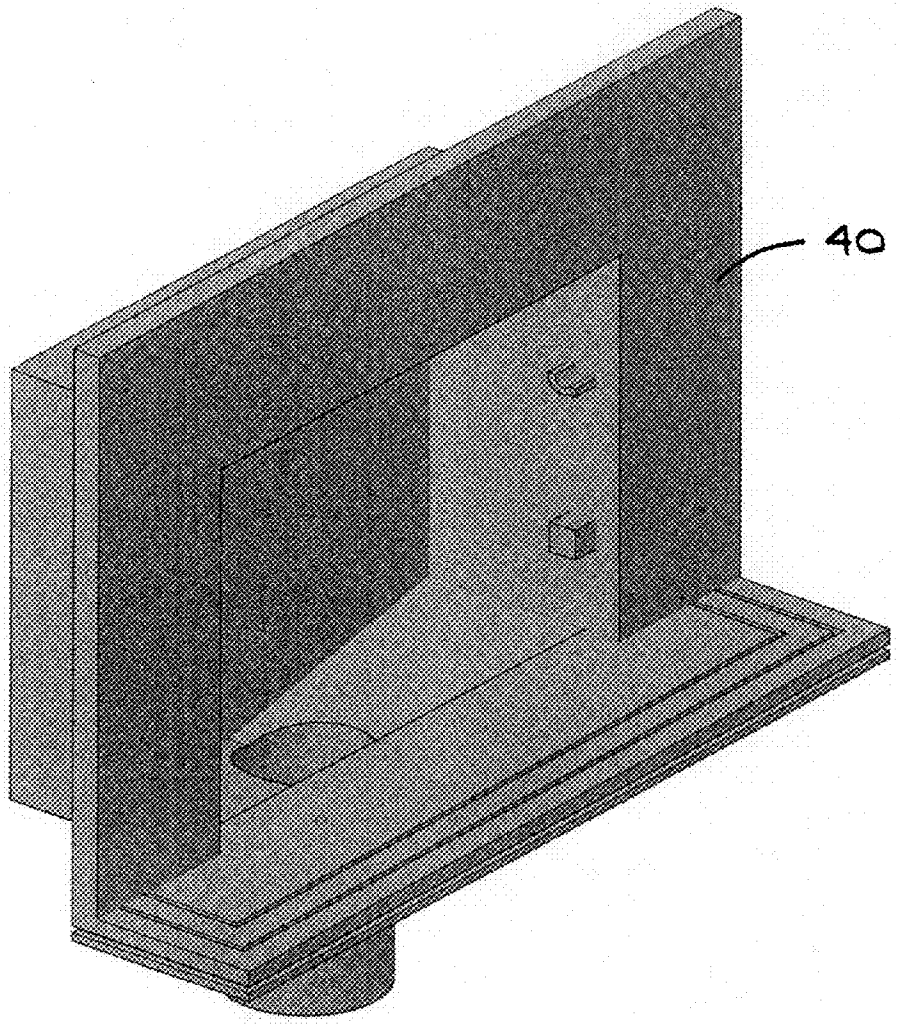
FIG. 8 is a perspective view showing the top and front of a wall drain embodiment of the present invention with the access panel removed.
Figure 9:
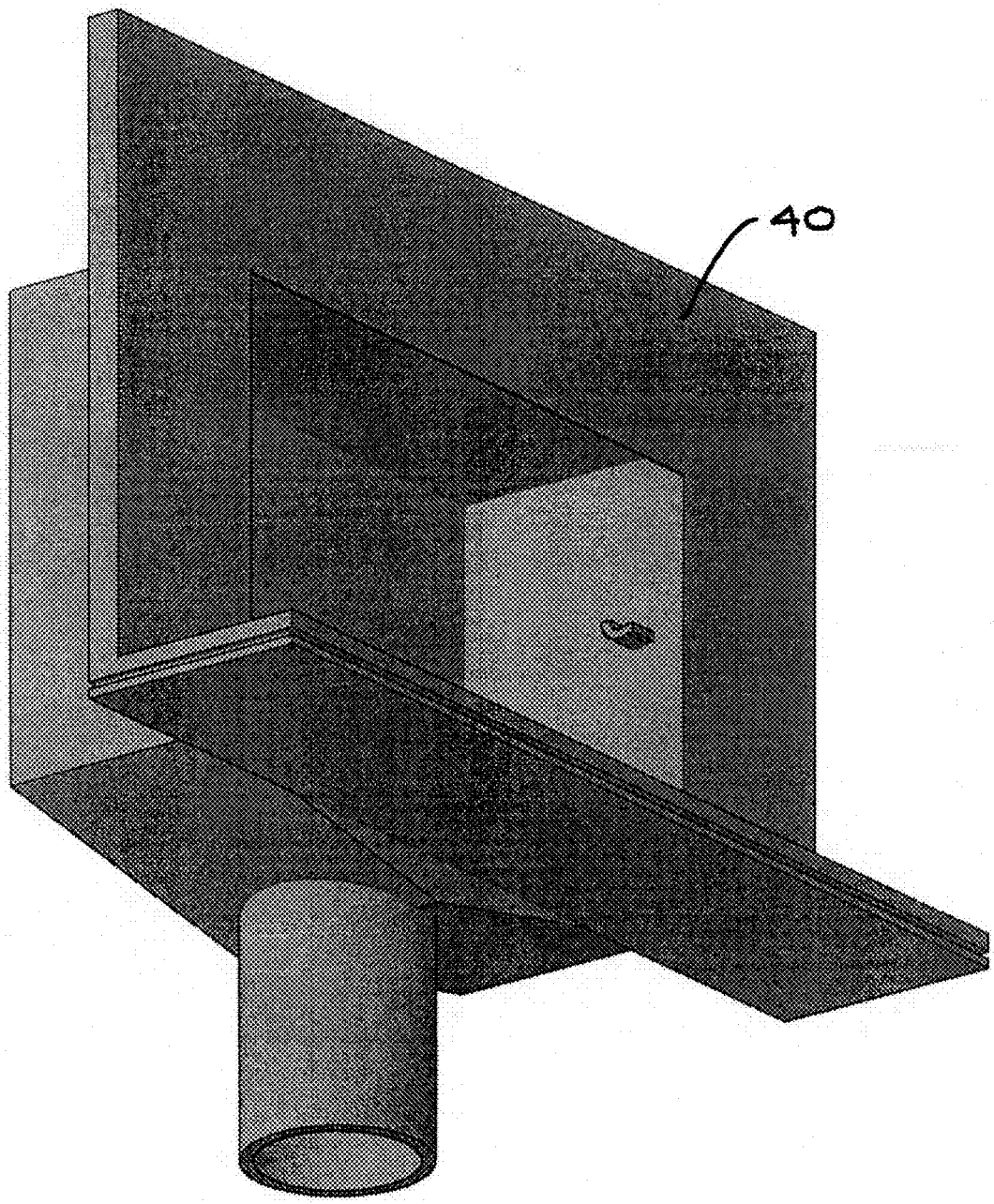
FIG. 9 is a perspective view showing the bottom an front of a wall drain embodiment of the present invention with the access panel removed.
Figure 10:
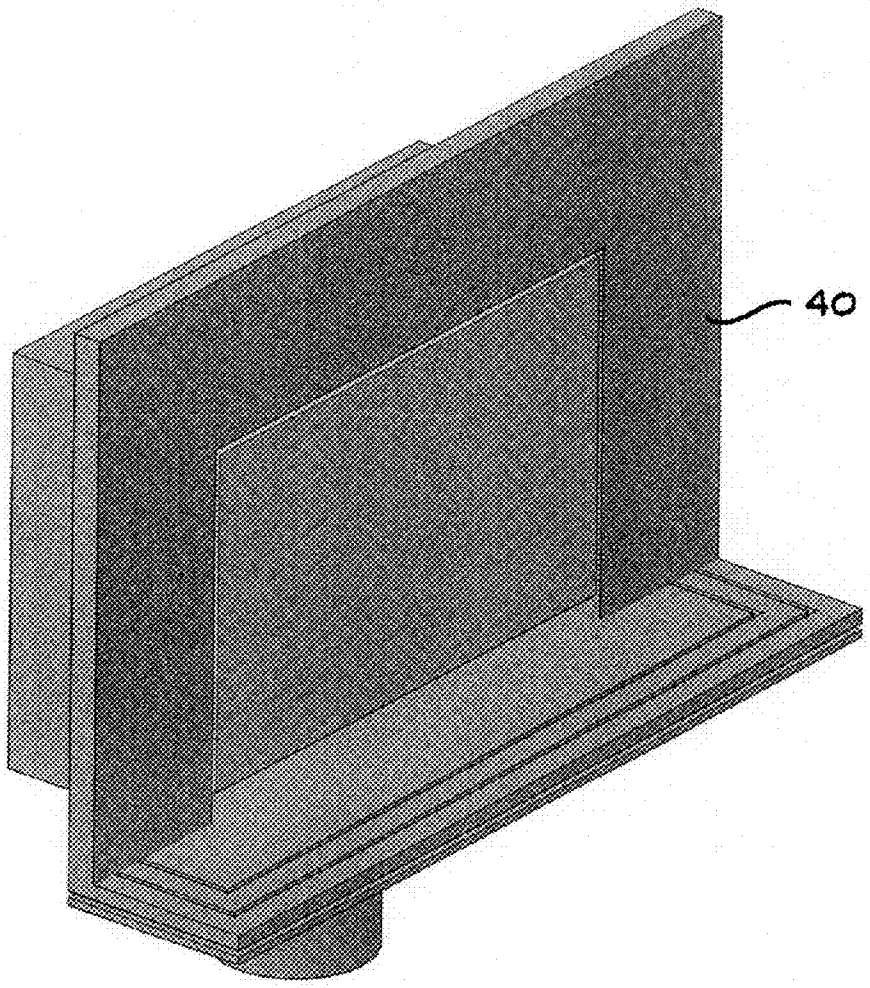
FIG. 10 is a perspective view showing the top and front of a wall drain embodiment of the present invention with the access panel in place.
Figure 11:
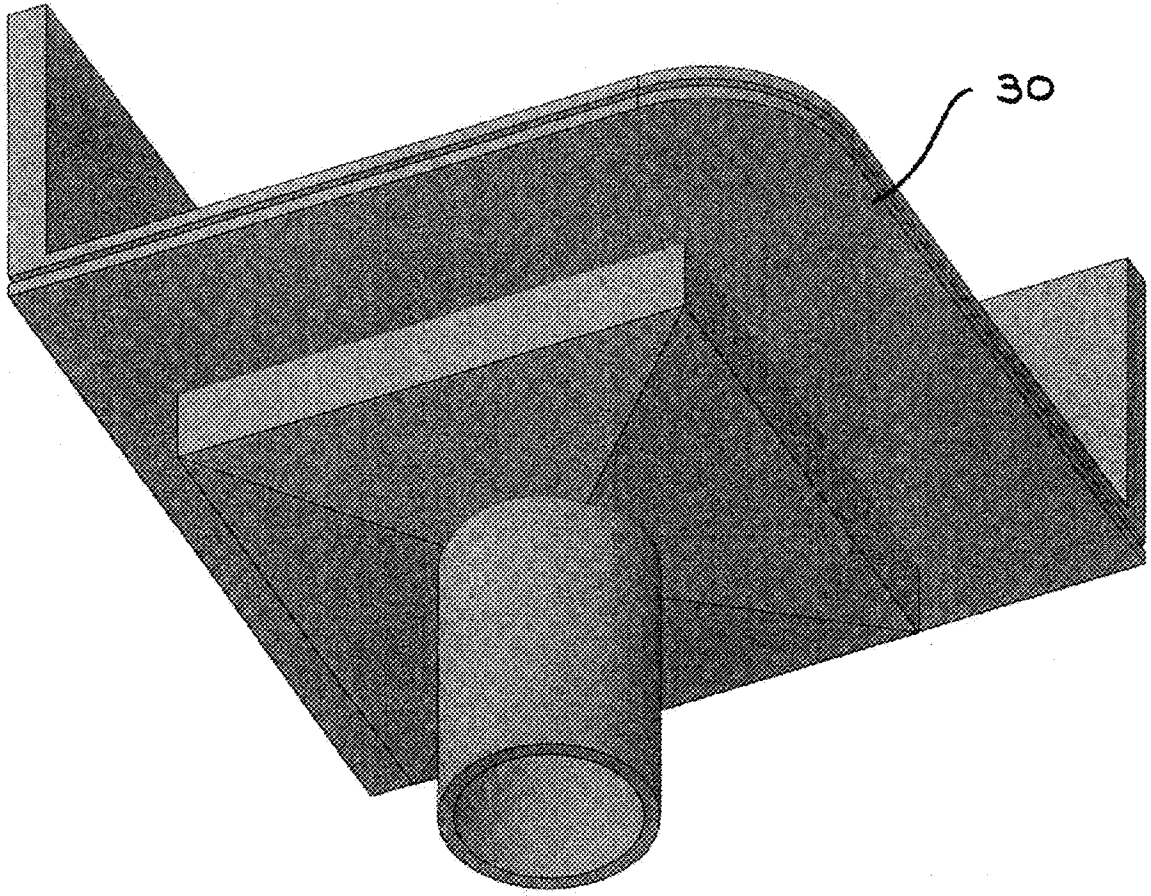
FIG. 11 is a perspective view showing the bottom of a corner drain embodiment of the present invention.
Figure 12:
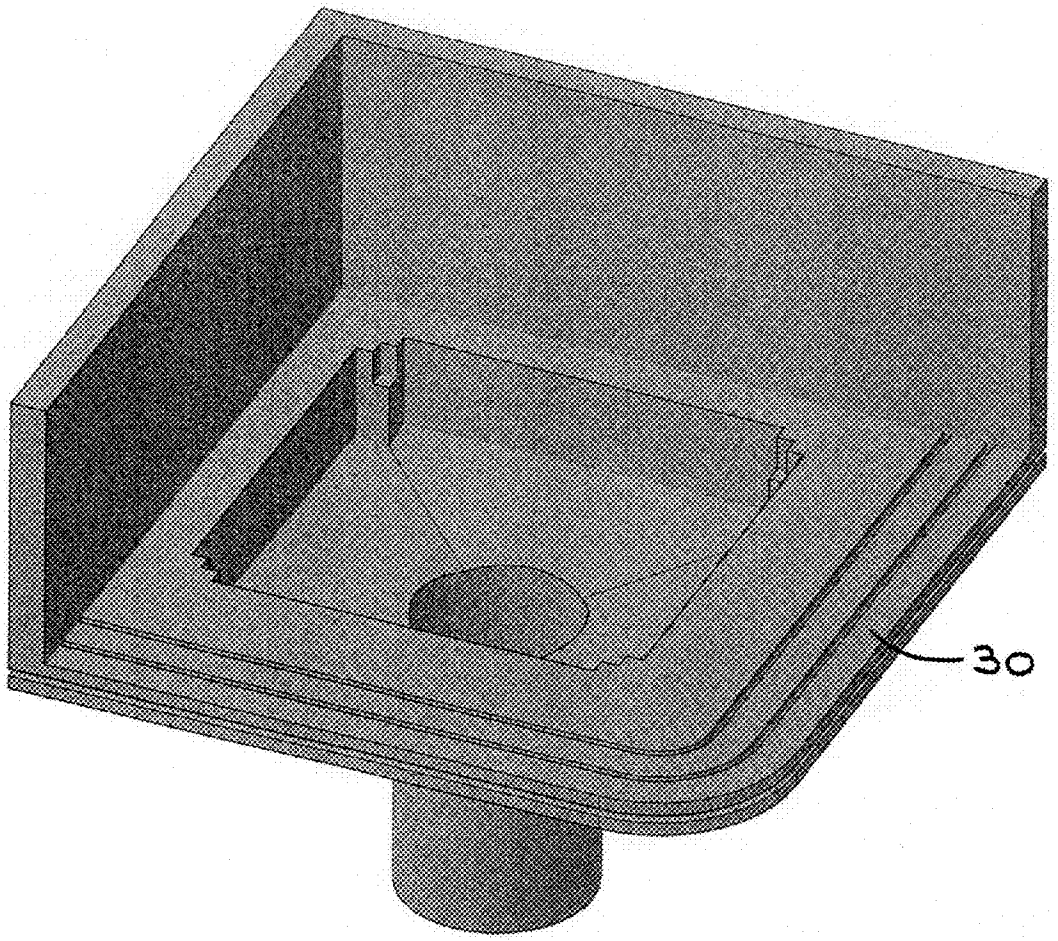
FIG. 12 is a perspective view showing the top of a corner drain embodiment of the present invention with the access panel removed.
Figure 13:
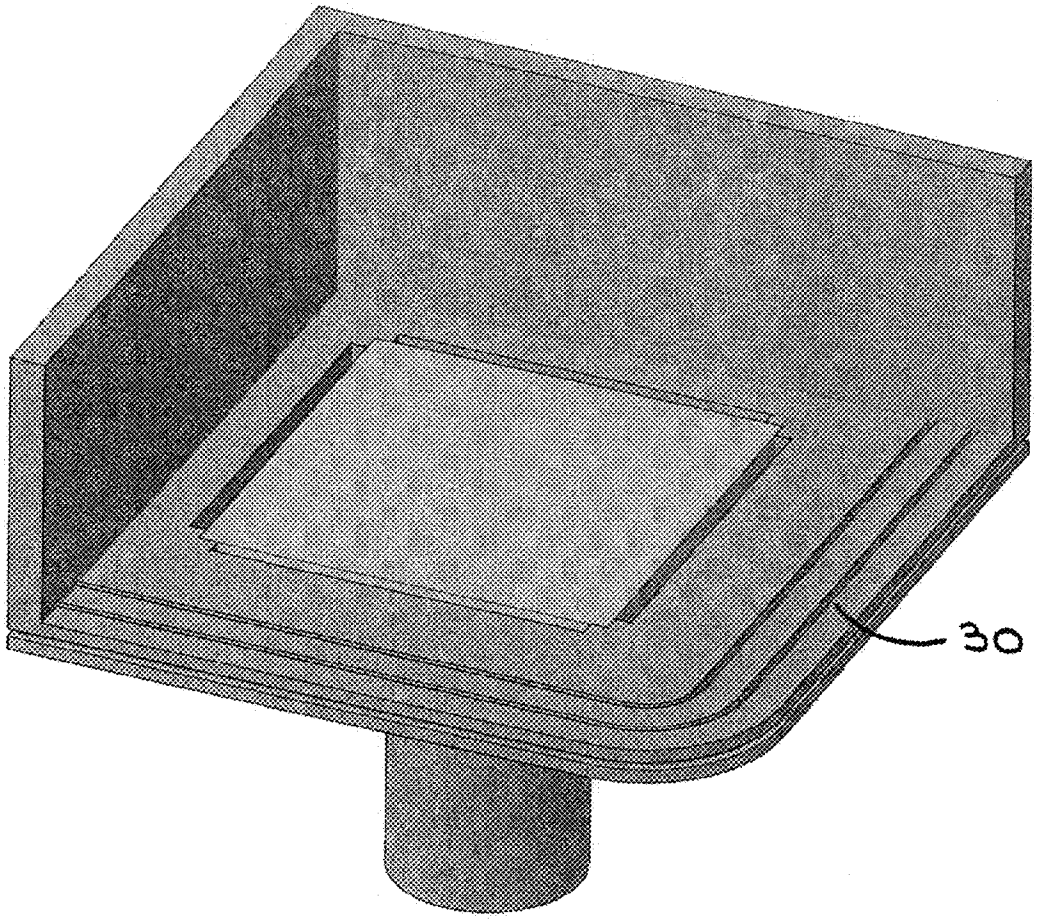
FIG. 13 is a perspective view showing the top of a corner drain embodiment of the present invention with the access panel in place.

FIGS. 4 and 11-12 show a corner drain assembly, generally indicated as 30, which is a variation of the present invention that is adapted to be installed in the corner of the floor of a shower. By way of example, a preferred embodiment of the corner drain assembly 30 has a ½-inch thick horizontal deck 33 that is 9½" by 9½" and has a 6-inch square removable access panel 36, which fits inside of a 6½ inch square drain opening 39. The corner drain assembly 30 has two vertical flanges 32 that each extend to a height of 4 inches above the horizontal deck 33.

FIGS. 5-10 show a wall drain assembly, generally indicated as 40, which is a variation of the present invention that is adapted to be installed in the wall of a shower. By way of example, a preferred embodiment of the wall drain assembly 40 has a ½-inch thick horizontal deck 43 that is 16 inches long and 3 inches wide. The wall drain assembly 40 has a single vertical flange 42 that is 14¼ inches wide and extends to a height of 9" above the horizontal deck 43. A 10¼ wide drain opening 49 is centered in the vertical flange 42, extending from the top of the horizontal deck 43 to a height of 7 inches. A removable 9¾"×6" access panel 46 rests on support tabs 48 affixed to the back side of the vertical flange 42, so as to provide a ¾-inch gap between the bottom of the access panel 46 and the top of the horizontal deck 43, a ¼-inch gap between the vertical sides of the panel 46 and the vertical flange 42, and a ¼-inch gap between the top edge of the panel 46 and the vertical flange 42.

Many other modifications and other embodiments of the invention will come to mind to one skilled in the art to which this invention pertains having the benefit of the teachings presented in the foregoing descriptions and the associated drawings. For example:

The horizontal deck can be various shapes other than rectangular;

The thickness of the horizontal deck and the thickness of the vertical flange can be other than ½", but should preferably be the same thickness as the cement board or other material upon which the shower tile is to be adhered;

The opening in the deck can be various shapes other than substantially rectangular;

Rather than being molded of a single component, the horizontal deck, the drainage box, the support posts and the vertical flange can be rigidly welded or glued to adjacent parts of the assembly;

The panel guides and the support posts may be constructed as individual components or may, alternatively, be formed from a single component;

The outboard corners of the horizontal deck can have radii or may be sharp corners;

The material of construction of the drain assembly can be plastic or other such rigid waterproof materials.

The horizontal deck can be secured in place on a shower subfloor without the use of a silicone sealant; and, In the preferred embodiment of the invention drain pipe 4 comprises 2" plastic pipe, but different sizes of pipe and different pipe materials can be alternatively used;

In a wall drain embodiment of the invention, such as illustrated in FIGS. 5-10, the deck member and access panel are in a vertical plane, and the drainage box and drain pipe are located behind the shower wall;

In a corner drain embodiment of the invention such as illustrated in FIGS. 3, 4 and 11-13, two adjacent sides of the horizontal deck plate are provided with contiguous vertical flanges that are adapted to be fastened to two adjacent shower walls.

Therefore, it is to be understood that the invention is not to be limited to the specific embodiments disclosed and that modifications and other embodiments are intended to be included within the scope of the appended claims.

I claim:

1. A shower floor drain comprising:

A horizontal rigid deck member having first and second parallel sides and third and four parallel sides;

an opening in said horizontal rigid deck member extending from a top surface of said deck member to a bottom surface of said deck member;

a drain box positioned beneath said opening in said deck member, said drain box having a closed wall extending downwardly from said bottom surface of said deck member;

said drain box further comprising a drain box bottom continuously connected to the bottom of said closed wall;

a downwardly directed drain pipe attached to said drain box bottom;

an opening in said drain box bottom leading from said drain box bottom to an open upper portion of said drain pipe;

a rigid vertical flange member continuously attached to said first side of said deck member and extending upwardly from said top surface of said deck member;

said opening in said deck member having first and second opening sides, said first and second opening sides being parallel to each other, and said first and second opening sides being parallel to said first and second deck sides;

a removable rigid access panel, said access panel having a first panel thickness measured between an upper surface of said access panel and a bottom surface of said access panel;

a plurality of support posts;

each of said plurality of support posts being attached to an interior surface of said closed wall;

each of said plurality of support posts having an upwardly facing first horizontal post surface adapted to removably engage said bottom surface of access panel, said upwardly facing first horizontal post surface being vertically positioned below said top surface of said deck member a distance equal to said first panel thickness;

each of said plurality of support posts further having an upper post portion extending above said upwardly facing first horizontal post surface, and said upper post portion being attached to an interior surface of said closed wall, and said upper post portion having a first post thickness and said upper post portion extending horizontally away from said closed wall into said opening in said horizontal rigid deck member a distance equal to said first post thickness; and, wherein a first pair of said plurality of support posts are disposed on opposite sides of said opening in said horizontal rigid deck member.

* * * * *